United States Patent [19]

Miller et al.

[11] Patent Number: 4,468,357

[45] Date of Patent: Aug. 28, 1984

[54] PUMP MEANS AND COUPLING MEANS FOR EVAPORATIVE COOLER

[76] Inventors: Cecil V. Miller; Erma M. Miller, both of P.O Box 3646, Riviera, Ariz. 86442

[21] Appl. No.: 417,138

[22] Filed: Sep. 13, 1982

[51] Int. Cl.[3] ..... B01F 3/04

[52] U.S. Cl. ..... 261/29; 62/310; 62/314; 261/36 R; 261/DIG. 3

[58] Field of Search ..... 261/29, 35, 24, 36 R, 261/37, 66, 121 M, DIG. 3; 62/310, 314

[56] References Cited

U.S. PATENT DOCUMENTS

| | | | |
|---|---|---|---|
| 1,051,661 | 1/1913 | Anderson | 261/29 |
| 1,976,956 | 10/1934 | Maclean | 261/66 X |
| 2,091,198 | 8/1937 | Fabry | 261/35 |
| 2,275,428 | 3/1942 | Haldeman | 261/121 M |
| 2,625,111 | 1/1953 | Eisenhuth | 261/35 X |
| 2,730,905 | 1/1956 | Pence | 261/29 X |
| 2,769,620 | 11/1956 | Davison | 261/29 X |
| 2,788,198 | 4/1957 | Anderson | 261/29 |
| 3,206,176 | 9/1965 | Peterson | 261/29 |
| 4,361,525 | 11/1982 | Leyland | 261/29 X |
| 4,400,185 | 8/1983 | Goettl | 261/29 X |

*Primary Examiner*—Richard L. Chiesa
*Attorney, Agent, or Firm*—Harlan P. Huebner

[57] ABSTRACT

This invention relates to an evaporative cooler with improved water pump means wherein a single motor will operate the cooler fan and the pump. The water pump is of the impeller type that draws water therein and it will exit by one or more outlets. In addition there are new and unique coupling means which extend from the single motor to the pump whereby activation of the motor will rotate both the pump and a fan forming a part of the evaporative cooler.

2 Claims, 8 Drawing Figures

PUMP MEANS AND COUPLING MEANS FOR EVAPORATIVE COOLER

FIELD OF THE INVENTION

This invention relates to a pump means and coupling means for moving water from a reservoir in the bottom of an evaporative cooler to a water manifold at the top of said cooler for dripping water down the sides of the cooler.

BACKGROUND OF THE INVENTION

Evaporative or "swamp" coolers are generally rectangular box like structures mountable on the roof of a building. The cooler usually includes corners, top and bottom frame members with porous water absorbing material such as excelsior forming the vertical walls thereof. A centrifugal or "squirrel" cage fan is usually provided to draw air in through the wet porous material and channel the same through the cage to a duct conveying the air into the building.

In order to cool the air, water is provided to drip from the top of the cooler by a manifold through the porous material ending at the bottom of the cooler in a dish or reservoir for reuse.

Various types of pumps and couplings have been employed to move the water upward from the reservoir to the manifold for distribution into the porous material. Some of such water pumps were powered by small motors separate from larger motors used to drive the centrifugal fan. These smaller motors often malfunctioned and required repair. Further, some of the water pumps in the past did not include filtration means and became clogged and would not function.

OBJECTS OF THE INVENTION

An object of the invention is to provide a water pump of the impeller type which can be activated and move water from a base reservoir vertically to a water manifold at the top of the cooler for distribution over porous material forming the four sides of the cooler.

Another object of the invention is to provide a coupling means between the water pump and a single electric motor for driving the squirrel cage blower of the cooler.

A further object is to provide a water pump of the impeller type that includes a filtration or strainer cover to strain any relatively large foreign matter out of the water which might cause injury to the pump.

Another object of the invention is to provide an impeller pump which may have a single or double exit configuration.

A still further object of the invention is to provide a flexible shaft means extending from the single motor to the pump to rotate the same.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustration purposes.

DETAILED DESCRIPTION OF THE PREFERRED EMBODIMENTS

Figure 1:
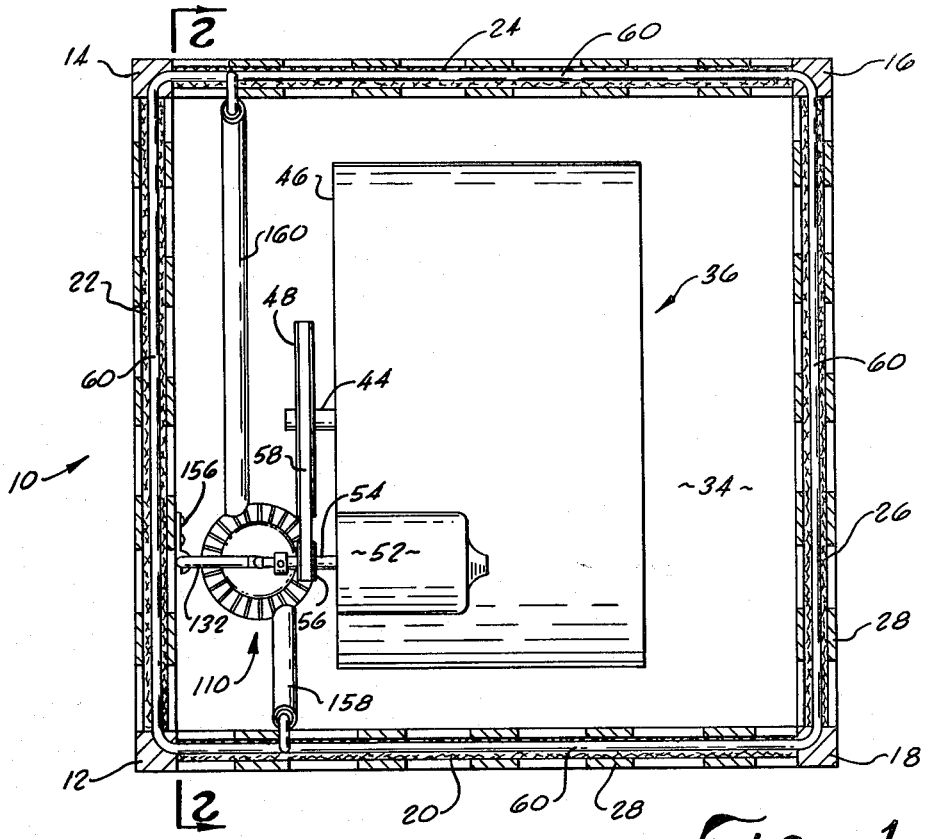
FIG. 1 is a top elevational view partly in section of an evaporative cooler illustrating the present invention.
Figure 2:
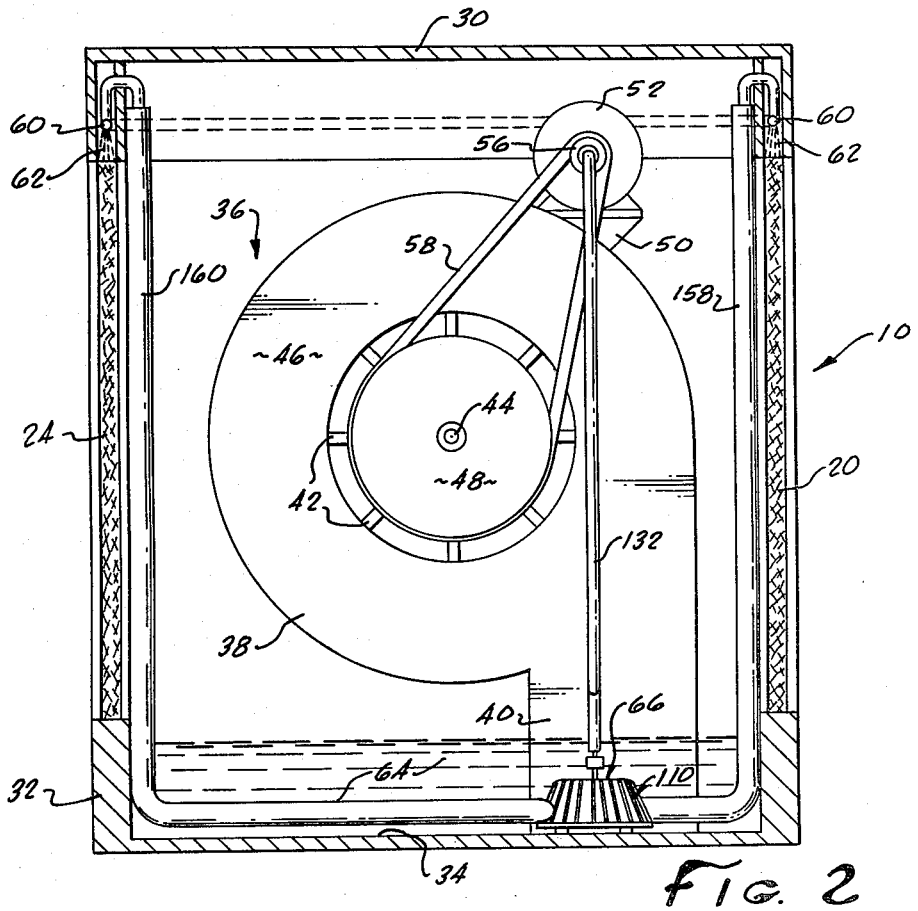
FIG. 2 is a side elevational view partly in section taken on line 2—2 of FIG. 1.

FIGS. 1 and 2 show a conventional evaporation cooler 10 sometimes referred to as a "swamp cooler" which is generally square in dimension. The cooler 10 includes four corner vertical posts 12, 14, 16 and 18. Extending between the respective posts 12 and 14, 14 and 16, 16 and 18 and 18 and 12 are sheets of porous material such as excelsior forming sides 20, 22, 24 and 26. In order to reinforce the sides 20, 22, 24 and 26 vertical stiffing members 28 may be provided.

In FIG. 2 there is illustrated a top member 30 which fits over the side walls. The member 30 is usually metal so that the interior machinery is protected from the elements. Also best seen in FIG. 2 is a bottom pan 32 which forms a water reservoir 34 on the inside of the pan 32.

Mounted within the cooler 10 is a conventional centrifugal type fan or squirrel case fan generally designated 36. The housing 38 is fitted with a duct 40 that extends downward through an opening (not seen in the drawing) to communicate with the interior of a building. The fan 36 includes a plurality of fan blades 42 mounted in the round housing 38 extending from a central shaft 44.

The shaft 44 extends outward from the side panel 46 of the housing 38. Journalled on the shaft 44 is a large belt pulley 48. At the top of the housing 38 is a motor mount 50, best seen in FIG. 2. Secured on the mount 50 is an electric motor 52 having a shaft 54 projected therefrom. Journalled on the shaft 54 is a relatively small belt pulley 56 which is aligned with the pulley 48. An endless drive belt 58 extends around the pulleys 48 and 56 so that when the motor is activated the pulleys rotate and the fan blade 42 will suck air into the side of the housing 38 opposite side 46 in view of the fact that the opposite side is open. The air will be drawn through the porous side walls 20, 22, 24 and 26 and forced down the duct 40.

The object of the evaporative cooler 10 is to cause water to flow downward in the porous walls 20, 22, 24 and 26 so that the air drawn in is cooled as it passes over the water when being pulled into the cooler by the fan 36.

In order to accomplish the distribution of water a water manifold 60 in the form of an endless pipe is suspended above the porous sides 20, 22, 24 and 26 within the top member 30, as best seen in FIGS. 1 and 2. In the bottom of the manifold 60 are a plurality of holes (not seen) whereby water in a spray form 62 may pass to the porous material some of which will drip down the material by gravity and return to the water 64 in the reservoir 34. A source of new water may be added to the reservoir by any conventional means.

To move the water 64 to the manifold 60 a new and unique pump generally designated 66 is provided. In addition, the pump is uniquely activated through the single electric motor 52 by means of a flexible connection to be described.

The preferred embodiment of the pump 66 is best seen in FIGS. 3 through 6. The pump 66 is an impeller type pump and sits in the reservoir 34 so that when it is activated water will be drawn from the reservoir through the pump 66 to appropriate conduits to the manifold 60.

The pump 66 is round and includes a housing 70 formed of an annular side wall 72, a bottom 74 and parallel top 76. The side wall 72, bottom 74 and top 76 form a water chamber 78. Extending downward from the bottom 74 are a pair of legs 80 that sit on the bottom of the pan 32. In this way the bottom 74 is elevated, whereby the vacuum will be broken by the ports 82, best seen in FIGS. 2 and 6. In addition to the bottom ports 82 the top 76 includes a pair of elongated water inlets 84 and 86 so that water 64 may be pulled into the inlets as shown by the upper arrows in FIG. 5. In addition, mounted on the top 76 are a pair of hinged plates 88 and 90 of the same contour as inlets 84 and 86. These plates 88 and 90 can be pivoted over the inlets and restrict the same to control the amount of water passing into the pump 66.

Figure 4:
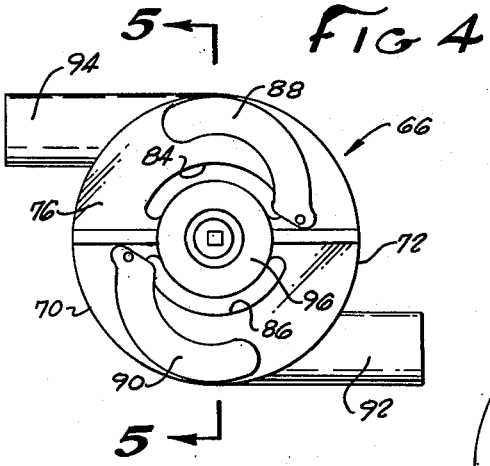
FIG. 4 is a top plan view of the preferred water pump.
Figure 3:
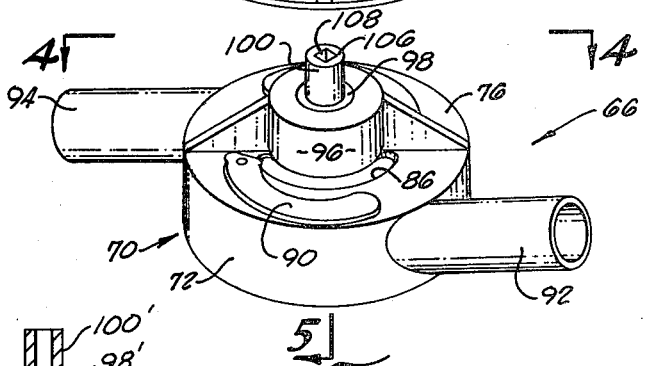
FIG. 3 is an exploded perspective view of the water pump and coupling means.

As best seen in FIGS. 3 and 4 there are a pair of water outlet nipples 92 and 94 which extend from the side wall 72 and communicate with the chamber 78.

Extending upward from the top 76 in the center thereof is bearing collar 96 which is fitted with a bearing 98. Extending through the bearing is an impeller shaft 100 which is joined to a two bladed impeller 102, FIG. 5, rotatable in the chamber 78. In order to facilitate the rotation of the impeller 102 the shaft 100 is seated in a thrust bearing 104 projecting from the bottom 74. The top 76 of the shaft 100 is formed with a recess 108 of a square cross-section, see FIG. 3.

Fitted over the pump 66 is a strainer or filter element 110 which is preferably frusto-conical as best seen in FIG. 3. However, it should be realized that the sides of the strainer 110 may be vertical without departing from the spirit of the invention. The strainer element 110 is preferably formed of plastic and is adapted to fit over the pump 66 and filter or strain large foreign elements that might be in the water 64 as it is drawn into pump 66.

Figure 5:
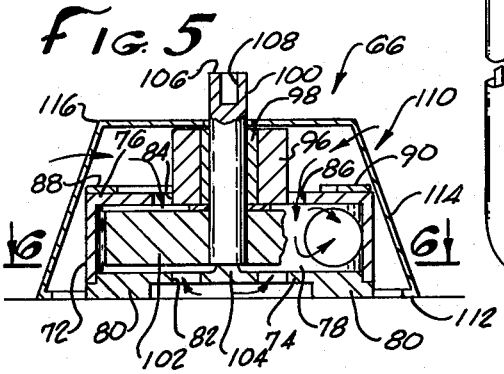
FIG. 5 is a cross-sectional view of the pump taken on line 5—5 of FIG. 3.
Figure 6:
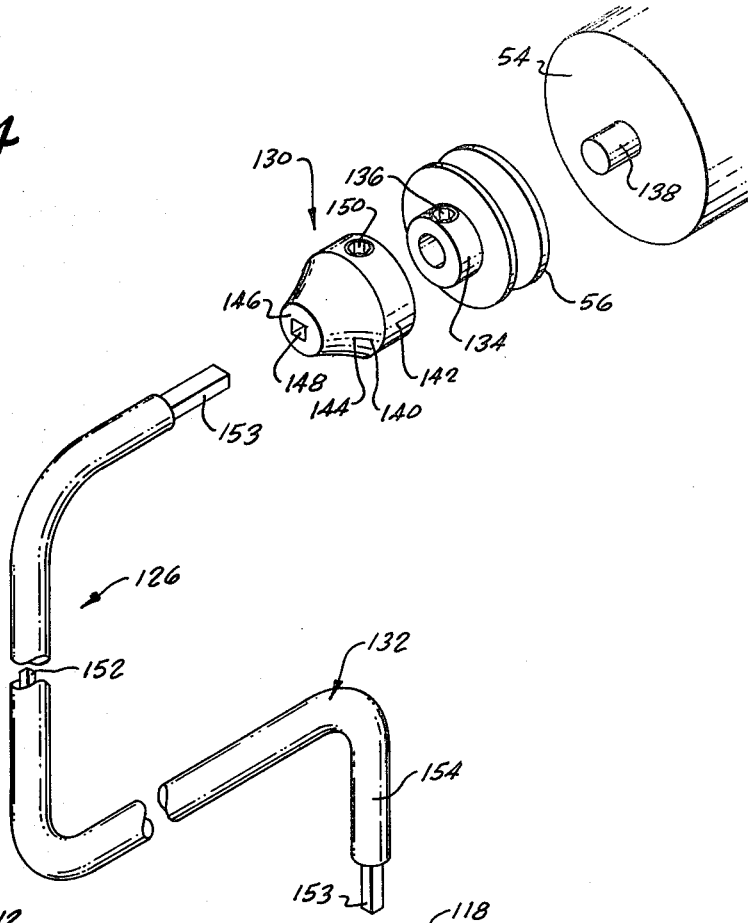
FIG. 6 is a plan view of the bottom of the pump taken on line 6—6 of FIG. 5.
Figure 6:
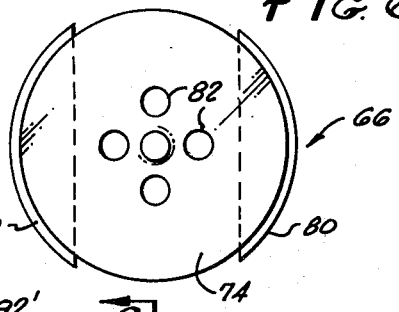

The strainer element 110 includes circular bottom 112 which will rest on the pan 32 over the pump 66, see FIG. 5. The annular side wall 114 extends upwardly and tapers inwardly to an annular top rim 116 of lesser diameter than the bottom 112. There is also an annular top wall 118. Centrally located in the annual top wall 118 is an opening 120 through which will extend the impeller shaft 100, see FIG. 5. In addition these are two semi-circular openings 122 (only one observable in FIG. 3) in the annular side wall 114 which fit the nipples 92 and 94 so the strainer element 110 will encase the pump 66.

In addition the strainer element 110 is formed with a plurality of slots 124 in the wall 114 to allow water 64 to pass through but yet they are small enough to prevent large pieces of foreign matter from passing therethrough. While slots are shown and preferred a number of small circular openings will accomplish the intended strainer purpose.

As has become evident there is only a single electric motor to activate the fan 36 and the pump 66. In order to accomplish the roration of the pump 66 a coupling means 126 is associated with the motor shaft 54. The coupling means 126 includes a motor shaft connector means 130 and a flexible shaft means 132.

The motor shaft connector means 130 includes on the conventional pulley 56 a shank 134 with a set screw 136 to mount the pulley to the stub 138 of the shaft 54. Secured to the shank 134 is a coupling adaptor 140 which includes an annular wall 142 and an outwardly inwardly tapered wall 144 terminating in a flat end wall 146. There is a recess 148 which is square in cross-section which extends into the adaptor 140. At the end remote from the end wall 146 there is an annular opening (not seen) adapted to fit over the shank 134 A set screw 150 in the wall 142 will retain the adaptor 140 to the shank 134.

Uniting the adaptor 140 and pump 66 there is the flexible shaft means 132 which includes a rotatable rod shaft 152 which is flexible and includes ends 153 which are square in cross-section to interfit within recess 148 at one end and in recess 108 at the other end. The shaft 132 is preferably covered with insulation 154. In the case of the illustration in FIG. 1, the flexible shaft 152 is bent to fit within a bracket 156 on the side of the wall 22.

Thus with rotation of motor shaft 54 through the coupling means 126 the pump 66 will be rotated and draw the water 64 into the pump 66 passing it out the outlet nipples 92 and 94 into hoses 158 and 160 respectively connected thereto. The hoses 158 and 160 extend upward, see FIG. 1 to the manifold 60 to assure a continuous flow of water down the panels of porous material so that the air pulled in through the panels or walls will be cool as it enters the building.

Figure 7:
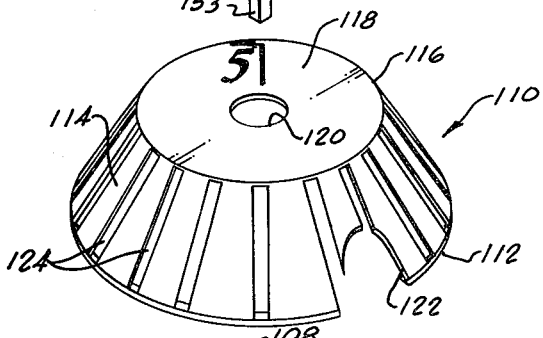
FIG. 7 is a top plan view partially in section of a modified water pump with only a single outlet or exit means.
Figure 7:
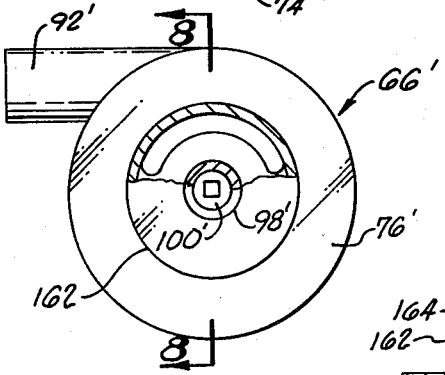
Figure 8:
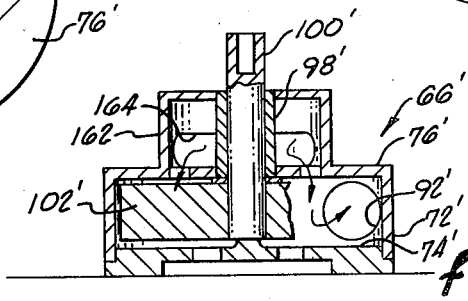
FIG. 8 is a cross-sectional view of the modified pump taken on line 8—8 of FIG. 7.

With regard to FIGS. 7 and 8 there is illustrated a modified pump 66'. The pump 66' includes side wall 72', top 76' and bottom 74'. In addition mounted on the top 76' is a bearing 98' which is surrounded by an inlet collar 162. The difference over the pump 66 resides in the fact pump 66' has the water inlets 164 in the collar 162, best seen in FIG. 8 and there is a single water outlet nipple 92'.

The impeller shaft 100' and impeller 102' remain the same as with the preferred embodiment.

While the above embodiments have been disclosed as the best mode presently contemplated by the inventor, it should be realized that these examples should not be interpreted as limiting, because artisans skilled in this field, once given the present teachings can vary from these specific embodiments. Accordingly, the scope of the present invention should be determined solely from the claims.

We claim:

1. In an evaporative cooler mountable on a structure including four walls of porous material, a bottom pan forming a reservoir for water and a top cover and mounted within said cooler is a centrifugal type fan including a duct communicating with said structure and said fan is adapted to draw air through the porous material and force the same through said duct into said structure, a motor having a single drive shaft projected from one end with a pulley mounted thereon and a drive belt extending to said fan to rotate said fan and a water manifold adjacent said top cover overlying said four walls of porous material and pump means to deliver water from said reservoir to said manifold to dispense water down the porous material, the improvement comprising:

a water pump resting in said reservoir, said pump including water inlet means and at least one said water outlet means including a hose to deliver water to said manifold, impeller means in said pump to draw said water into said pump and vacuum breaking means to assure a free smooth flow of water out said water outlet means;

a flexible drive shaft having one end connected to said motor drive shaft adjacent said pulley and a second end connected to said water pump for direct drive of said pump simultaneously with said fan whereby water in said reservoir is pumped to said manifold; and a frusto-conical strainer having a plurality of slots spaced therearound to allow water to be drawn therethrough into said pump as well as to prevent introduction of certain foreign matter into said pump.

2. In an evaporative cooler as defined in claim 1 wherein said water pump includes two outlet means each connected to a hose whereby water may be delivered to two areas of said manifold to increase the volume of water to be dispensed to said porous material.

* * * * *